United States Patent [19]

Loos

[11] 4,111,001

[45] Sep. 5, 1978

[54] ROOM AIR CONDITIONER DOOR OPERATING MECHANISM

[75] Inventor: John H. Loos, Dayton, Ohio

[73] Assignee: General Motors Corporation, Detroit, Mich.

[21] Appl. No.: 801,862

[22] Filed: May 31, 1977

[51] Int. Cl.[2] ..... F25D 17/06

[52] U.S. Cl. ..... 62/427

[58] Field of Search ..... 62/427

[56] References Cited

U.S. PATENT DOCUMENTS

| | | | |
|---|---|---|---|
| 3,194,028 | 7/1965 | Bell | 62/427 X |
| 3,762,182 | 10/1973 | Loos et al. | 62/427 |

*Primary Examiner*—Gerald A. Michalsky

*Attorney, Agent, or Firm*—Edward P. Barthel

[57] ABSTRACT

A door operating mechanism for an air conditioning unit including a bellcrank actuator and pressure plate assembly having an offset pivot point. The outer end of the actuator arm is connected to the door by a resilient linear push-pull rod. The door is releasably retained in a plurality of intermediate open positions by rotation of the actuator between its closed or fully open position and with the push-pull rod having a predetermined length with respect to the door and the actuator in its closed position whereby upon the actuator being retained in its door closed position, the push-pull rod is resiliently bowed to provide a biasing force on the door to retain the same in a substantially air-sealed arrangement with the door opening.

3 Claims, 7 Drawing Figures

ROOM AIR CONDITIONER DOOR OPERATING MECHANISM

This invention relates to a door opening and closing mechanism for a room air conditioner and more particularly to an improved damper door operating mechanism for controlling the flow of air between the air conditioned space and the outdoor air.

Various vent or intake door arrangements have been used to allow for selective interchange of room and outdoor air in room air conditioners as exemplified by U.S. Pat. No. 3,762,182 issued Oct. 2, 1973 to John H. Loos, et al. and assigned to the same assignee as the present application. While the mechanism shown in the Loos patent has proved satisfactory the arrangement of having the door on one side of the cabinet and the control panel on the other side is not susceptible to an arrangement wherein the door and its associated control mechanism are required to be in substantial alignment.

It is an object of the present invention to provide an improved operating mechanism for a room air conditioner door including a push-pull rod, having one end secured to a pivotal operating mechanism and the opposite end secured to the door such that the push-pull rod has a predetermined length with respect to the door and the closure mechanism whereby upon the closure mechanism being pivoted into a positive door closed position, the push-pull rod is resiliently bowed to provide a biasing force on the door to retain the same in substantially air-sealed relation with a room air conditioner partition opening.

It is a further object of the present invention to provide an improved operating mechanism for a room air conditioner damper or vent door having selective means for opening and closing the damper including a generally T-shaped actuator and a pressure plate mechanism supported on a cabinet surface with the T-shaped actuator including a relatively short cross arm portion, a relatively long cross arm portion and a manually operated stem arm extending through aperture means in the unit's room side cover panel, and whereby the aperture means is in longitudinal alignment with the damper. A vertically extending pivot pin extends through the actutator short arm portion to secure same between the pressure plate and the cabinet surface. A resilient linear push-pull rod extends in a substantially longitudinal direction with one end of the rod secured adjacent to the free end of the actuator long cross arm portion and the opposite end of the rod secured to the damper. A recess on the actuator contacts the surface biasing a dimple on the long cross arm portion into frictional contact with the pressure plate, such that the cross arm dimple is in pressure slidable contact with the plate along an arcuate path whereby the actuator and damper may be releasably retained in a plurality of intermediate open positions by user movement of the stem arm. The pressure plate has a door closed and door open dimples, formed therein complementary with the actuator dimple, positioned in spaced relation at either end of the arcuate path such that the actuator dimple being selectively cooperable with either of the pressure plate dimples for releasable capture thereby positively retaining the damper in either its closed or fully open position.

These and other objects and advantages of the present invention will be apparent from the following description, reference being had to the accompanying drawings, wherein a preferred form of the invention is clearly shown.

Figure 1:
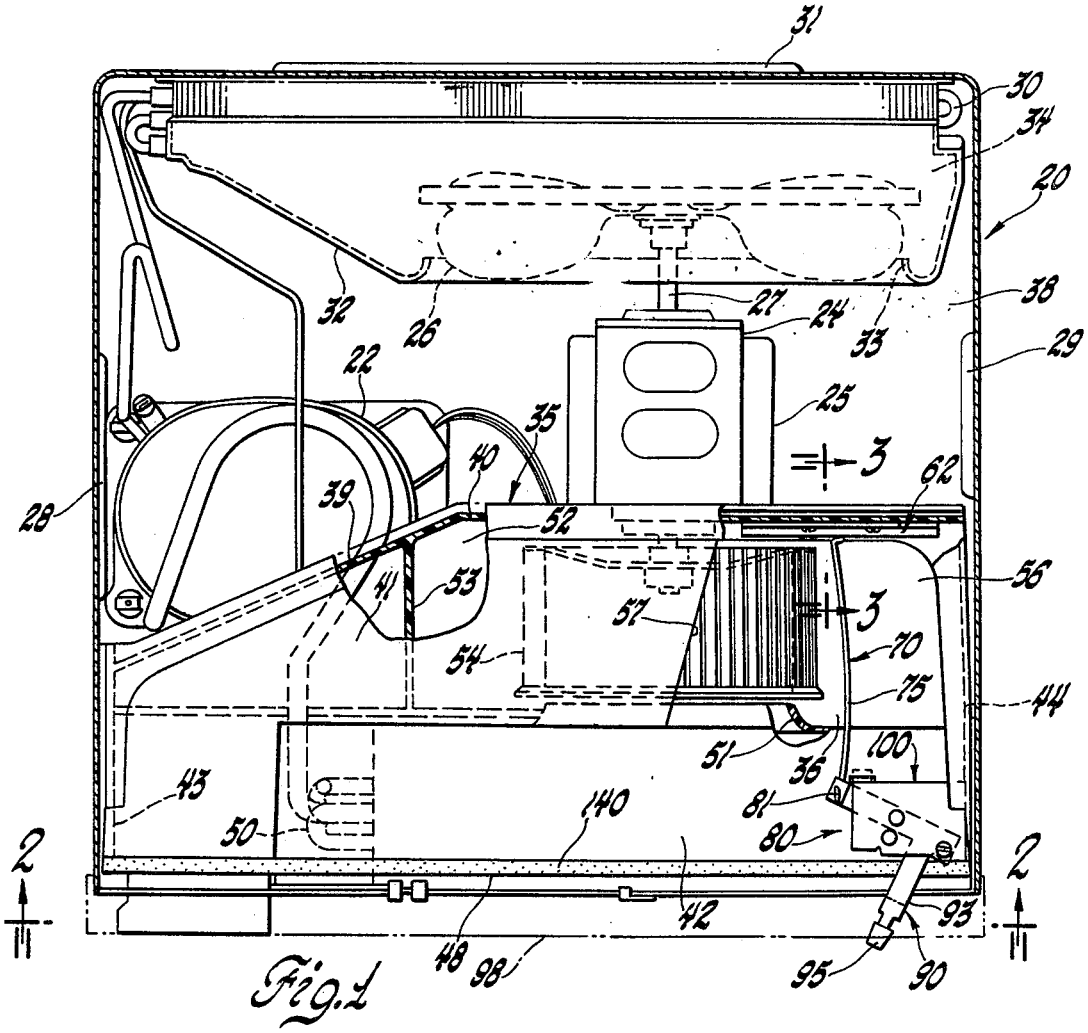
FIG. 1 is a top plan view of a room air conditioner having an arrangement according to the invention, with parts broken away, for the sake of illustration.

Referring now to the drawings and more particularly to FIG. 1, there is shown a window air conditioner unit having a weather casing 20 enclosing a sealed motor compressor unit 22, a support bracket 24 for a fan motor 25, having a propeller fan 26 mounted on one end of motor shaft 27 which draws in outside air through suitable side louvers 28 and 29 through a condenser 30 and discharges to the atmoshphere by means of louvers 31 at the back of the casing 20. A suitable condenser shroud 32 is provided with a bell mouth propeller fan orifice 33 to define a condenser air chamber 34.

An integrally formed transverse upright bulkhead partition, indicated generally at 35, extends across the casing 20 to divide the interior of the air conditioning unit into an inner evaporator compartment 36 and an outer compartment 38 in communication with the outside air. The bulkhead 35 includes vertical wall sections 39 and 40 and top wall section 41. Spaced below the top wall 41 is a horizontal shelf, indicated at 42 in FIG. 2, which together with the end walls 43, 44 define an upper room air discharge duct 46 having a conditioned air outlet 48 extending across the front of the air conditioner unit.

An evaporator 50 is located in front of a bell mouth inlet orifice 51 in the inner side wall 52 of a blower scroll housing 53. The blower wheel 54 is mounted on the other end of the electric motor shaft 27 for rotation within the scroll housing 53. Air discharged radially from the blower wheel 54 will cause routing of the high velocity flowing air to be directed in a counterclockwise direction through the winding spiral passageway of the blower scroll and through the exhaust opening 56, defined in part by skewed curled edge 57, into upper room air discharge duct 46. The room air enters the scroll housing through the bell mouth inlet orifice 51 and is directed into a generally vertical exhaust passageway (not shown) leading to opening 56.

Figure 3:
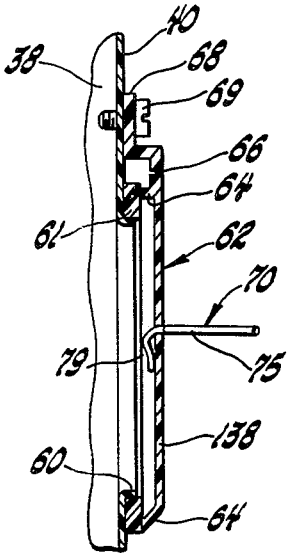
FIG. 3 is a fragmentary enlarged vertical sectional view of the door and door opening shown in FIG. 1.

With reference to FIGS. 1 and 3, the partition wall 40 is provided with a rectangular opening 60 surrounded by a gasket 61 of suitable rubber-like material. The opening 60 communicates with the outer housing compartment 38 to which stale or contaminated air may be removed from the room and exhausted into the compartment 38 from whence it is subsequently discharged into the atmosphere through the louvers 28 and 29.

As seen in FIG. 3, a fresh air damper or flapper door 62 for the opening 60 may be made of flexible plastic material having downturned peripheral edges 64 which when the door is closed extend into sealing engagement with the gasket 61 to seal the opening 60. The door 62 is provided with an integral flexible hinge 66 forming a pivot or "living hinge" section which connects to an angle-sectioned anchoring portion 68 fastened by a pair of screws 69 to the partition wall 40.

Figure 4:
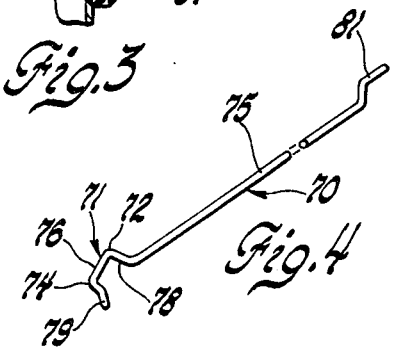
FIG. 4 is a perspective view of the push-pull rod.

A push-pull control rod 70 has its one or outer end suitably secured to the door 62 by double hook means 71 (FIG. 4) to permit control of the door. The rod double-hook means 71 includes a first right-angle hook 72 formed in a generally horizontal plane and a second right-angle hook 74 oriented in a generally vertical plane with the second hook bight portion 76 extending downwardly at an oblique angle of about 45 degrees from the first hook bight portion 75. The second hook 74 terminates in a free end obtuse bend portion 79 for a reason to be explained later.

Figure 5:
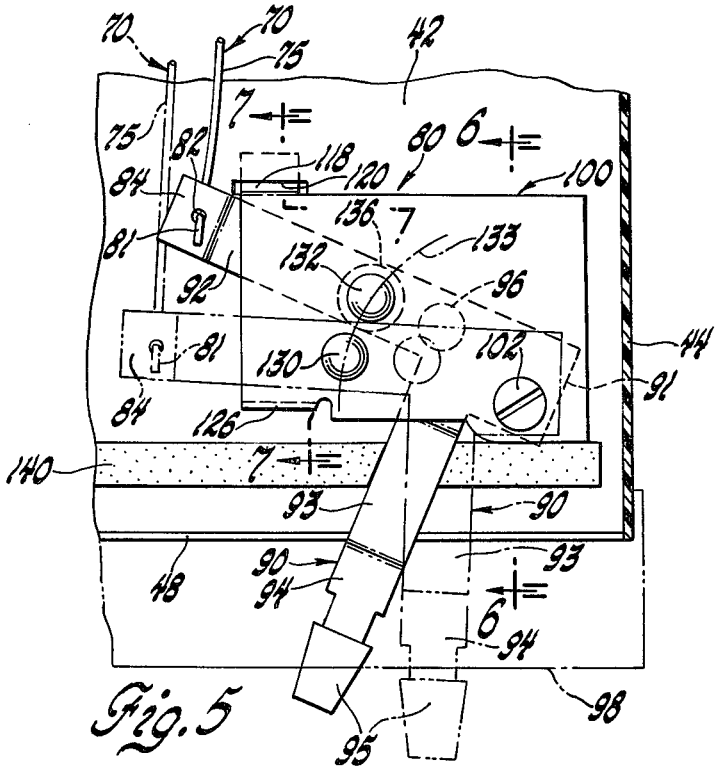
FIG. 5 is an enlarged fragmentary horizontal sectional view taken along the line 5—5 of FIG. 2.

It will be seen in FIG. 1 that the push-pull rod 70 has a flexible linear portion 75 extending from the door 62 in a generally longitudinal direction toward the room-side cover with its other or inner end secured to a door control assembly generally indicated at 80 in FIG. 5. The rod inner end is shaped in the form of a single-L hook 81 received in an aperture 82 located in upwardly offset flange portion 84 of the control assembly 80.

Figure 6:
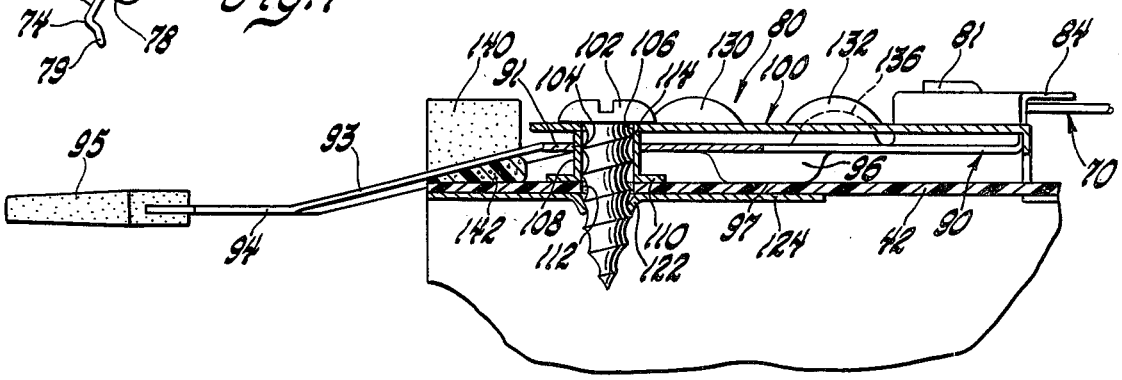
FIG. 6 is an enlarged fragmentary vertical sectional view taken substantially along the line 6—6 of FIG. 5.

The control assembly 80 includes an operating actuator 90 shown in its left or door locked closed position in FIG. 1. As best seen in FIG. 5, the actuator 90 is in the form of a bell-crank or generally T-shaped lever having a relatively short cross-arm portion 91, a relatively long cross-arm portion 92 and a manually operated handle or stem arm portion 93. The handle portion 93 slopes downwardly from the cross arm portions and terminates in a generally horizontal free end portion 94 on which a plastic button 95 is secured, such as by snapping on a bifurcated end (not shown) of the handle free end 94. In the disclosed form the handle portion 93 extends through suitable aperture means (not shown) in the air conditioner room side front cover, indicated by dash-dot lines 98 in FIG. 5. As best seen in FIG. 6, the juncture of the handle portion 93 and the long cross arm portion 92 has a downwardly depressed indent 96 having a planar bottom surface 97 which is in biased pressure contact with the upper surface of shelf 42. The control assembly includes a pressure plate 100 which overlies the actuator 90 and is secured thereto by means of a metal screw 102.

Figure 7:
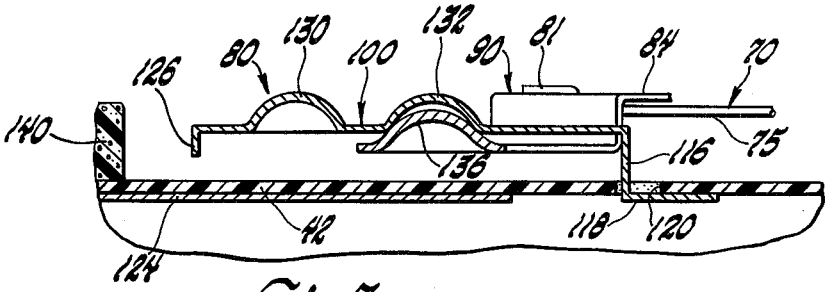
FIG. 7 is an enlarged fragmentary vertical sectional view taken substantially along the line 7—7 of FIG. 5.

With reference to FIG. 6, the actuator short cross arm portion 91 is provided with an opening 104 which aligns with openings 106 in the pressure plate 100 to accommodate pivot and spacer bushing 108 so as to enclose the threaded shank of screw 102. The bushing 108 has a flanged portion 110 centered around shelf opening 112 with the bushing upper end forming a shoulder 114 on which the pressure plate is partially supported. As seen in FIG. 7, the pressure plate 100 has a depending L-sectioned flange 116 with its outwardly extending foot portion 118 extending through shelf opening 120. Thus upon the screw 102 being tightened by means of its threads engaged by prongs 122 of shelf backing metal plate 124 the pressure plate 100 is fixedly secured. It will be noted in FIGS. 5 and 7 that the pressure plate 100 includes a lanced out positive stop flange 126 to prevent overtravel of the actuator 90 by engaging its long cross arm 92.

As best seen in FIGS. 5 and 6, the pressure plate 100 is formed with a pair of upwardly projecting dimples 130 and 132 the centers of which are located on an arc, shown by construction line 133, having its center of radius located on the axis of the screw 102. By virtue of being positioned in spaced relation at either end of arc 133, the plate dimple 130 provides a positive door closed position while the plate dimple 132 provides a positive door fully open position. The long cross arm portion 92 of the actuator 90 has an upwardly deformed spherical actuator dimple 136 which in the disclosed form is of a relatively larger size than the pressure plate dimples 130 and 132. The actuator dimple 136 is selectively cooperative with each of the pressure plate dimples for releasable capture thereby as shown by the cooperative relation between plate dimple 132 and actuator dimple 136 in FIG. 7. The fact that the actuator dimple 136 has a diameter of about twice the diameter of the pressure plate dimples 130 and 132 provides a clearance space between the underside of the pressure plate 100 and the actuator 90. This spacing provides line contact and thus easy release of the actuator dimple 136 from either of its captured positions with plate dimples 130 and 132 to any intermediate positions whereby the actuator dimple 136 is in slidable frictional contact with the pressure plate along the arc 133. It will be appreciated that the actuator flat bottomed indent 96 is of a predetermined size so as to contact the shelf 42 for urging or biasing the actuator dimple 136 into frictional contact with the pressure plate. As a result applicant's control assembly allows for selective retention or positioned stability between the actuator 90 and the pressure plate 100 in an infinite number of intermediate positions between door 62 in its positive fully opened position and its positive closed and sealed positions.

It will be noted that the push-pull rod 70 linear portion 75 has a predetermined length from its engagement with long cross arm aperture 82 to its point of contact between first hook bight portion 78 and the inner surface 138 of the door 62. With the pressure plate dimple 132 in engagement with actuator dimple 136 (FIG. 7) to positively close door 62, the push-pull rod linear portion 75 is resiliently bowed, as seen in FIG. 1, to provide a biasing force on the door 62 thus retaining the door in its substantially air sealed relation with the partition opening 60 as shown in FIG. 3. In the disclosed form the push-pull rod 70 is formed from 0.047 inches diameter spring wire and has a free linear length of about $7\frac{1}{8}$ inches from hook 81 to bight portion 78.

Figure 2:
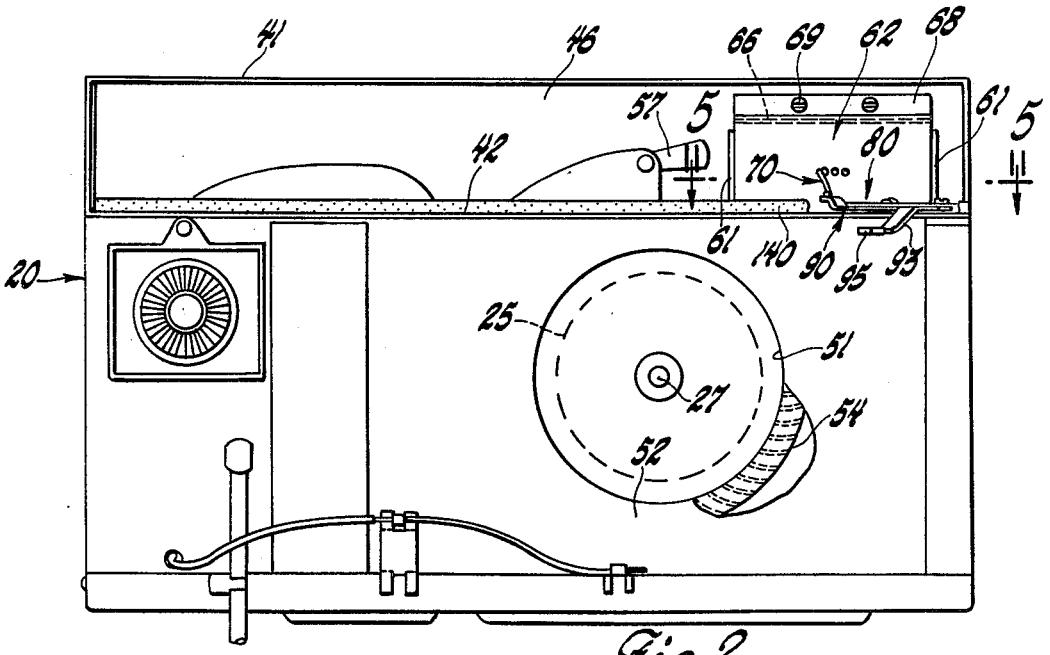
FIG. 2 is a front elevational view of the cabinet with the front cover removed, taken along the line 2—2 of FIG. 1.

With reference to FIGS. 2, 5 and 6 it will be seen that the cabinet has a foam rubber sealing strip 140 extending along the front edge of shelf 42 such that the downwardly angled portion 93 of the handle or arm depresses the strip 140 as at 142 as the arm is shifted between its operating positions.

While the embodiment of the present invention as herein disclosed constitutes a preferred form, it is to be understood that other forms might be adopted.

I claim:

1. In a room air conditioning unit having outer and inner compartments with a partition therebetween and an air flow opening in said partition with a door pivotally mounted adjacent the partition opening for movement between a closed and a fully open position, means in said inner compartment supporting a door control assembly for opening and closing said door so as to control the flow of air through the opening, said door control assembly comprising a bell-crank lever actuator and a pressure plate, said lever actuator including a cross arm portion and a manually operated stem arm normal to said cross arm portion accessible from the room side of said unit, pin means pivotally securing said lever actuator between said pressure plate and said inner compartment support means for pivotal movement of said lever actuator relative thereto, a resilient linear push-pull rod having one end thereof secured adjacent to one free end of said cross arm portion and its opposite end secured by double hook means to said door, indent means on said lever actuator contacting said support means for urging a dimple on said cross arm portion into frictional contact with said pressure plate, said cross arm portion dimple being in slidable contact with said pressure plate along an arc, whereby said door is releasably retained in a plurality of intermediate open positions by rotation of said stem arm, said pressure plate having a door-closed dimple and a door-open dimple formed therein positioned in spaced relation at either end of said arc, said cross arm portion dimple being selectively cooperable with each of said pressure plate dimples for releasable capture thereby to positively retain said door in either its closed or fully open position, and said push-pull rod having a predetermined length with respect to said door and said door-closed dimple whereby upon said cross arm portion dimple being captured by said door-closed dimple said push-pull rod is resiliently bowed providing a biasing force on said door to retain said door in a substantially air sealed relation with the partition opening.

2. In a room air conditioning unit having outer and inner compartments with a partition therebetween and an air flow opening in said partition with a door pivotally mounted adjacent the partition opening for movement between a closed and a fully open position, means in said inner compartment supporting a door control assembly for opening and closing said door so as to control the flow of air through the opening, said door control assembly comprising a generally T-shaped actuator and a pressure plate, said T-shaped actuator including a relatively short cross arm portion, a relatively long cross arm portion and a manually operated stem arm accessible from the room side of said unit, pin means pivotally securing said short arm portion between said pressure plate and said inner compartment support means for pivotal movement of said T-shaped actuator relative thereto, a resilient linear push-pull rod having one end thereof secured adjacent to the free end of said long cross arm portion and its opposite end secured to said door, indent means on said T-shaped actuator contacting said support means for urging a dimple on said long cross arm portion into frictional contact with said pressure plate, said long cross arm portion dimple being in slidable contact with said pressure plate along an arc, whereby said door is releasably retained in a plurality of intermediate open positions by rotation of said stem arm, said pressure plate having a door-closed dimple and a door-open dimple formed therein positioned in spaced relation at either end of said arc, said long cross arm portion dimple being selectively cooperable with each of said pressure plate dimples for releasable capture thereby to positively retain said door in either its closed or fully open position, and said push-pull rod having a predetermined length with respect to said door and said door-closed dimple whereby upon said long cross arm portion dimple being captured by said door-closed dimple said push-pull rod is resiliently bowed providing a biasing force on said door to retain said door in a substantially air sealed relation with the partition opening.

3. In a room air conditioning unit comprising an outer cabinet having top, bottom, side and rear walls defining an apparatus compartment, an inner cabinet defining a cooling compartment, said inner compartment having an open front closed by a room side closure member, and a partition between said compartments; said cooling compartment having an air inlet and an air outlet, a shelf spaced below said top wall which together with said side walls define a room air discharge chamber having a discharge air opening communicating with a room to be cooled; said partition having an opening therein communicating with both said compartments for exhausting air from the room, an air exhaust door pivotally mounted adjacent said partition opening for movement between closed and fully open positions, and selective means for opening and closing said door for exhausting air from the room, the improvement wherein said selective means includes a generally T-shaped actuator and a pressure plate supported on the shelf, said T-shaped actuator including a relatively short cross arm portion, a relatively long cross arm portion and a manually operated stem arm extending through aperture means in said room side closure member, said aperture means being in longitudinal alignment with said door, pin means pivotally securing said short arm portion between said pressure plate and said shelf for pivotal movement of said actuator relative thereto, a resilient linear push-pull rod extending in a substantially longitudinal direction with one end thereof secured adjacent to the free end of said long cross arm portion and its opposite end secured to said door, indent means on said T-shaped actuator contacting the shelf for urging a dimple on said long cross arm portion into frictional contact with said pressure plate, said long cross arm portion dimple being in slidable contact with said pressure plate along an arc, whereby said door is releasably retained in a plurality of intermediate open positions by rotation of said stem arm, said pressure plate having a door-closed dimple and a door-open dimple formed therein positioned in spaced relation at either end of said arc, said long cross arm portion dimple being selectively cooperable with each of said pressure plate dimples for releasable capture thereby to positively retain said door in either its closed or fully open position, and said push-pull rod having a predetermined length with respect to said door and said door-closed dimple whereby upon said long cross arm portion dimple being captured by said door-closed dimple said push-pull rod is resiliently bowed to provide a biasing force on said door to retain same in a substantially air sealed relation with said partition opening.

* * * * *